US006694539B1

(12) United States Patent
Kordell et al.

(10) Patent No.: US 6,694,539 B1
(45) Date of Patent: Feb. 24, 2004

(54) BUBBLE EASE

(76) Inventors: Randall Kordell, 218 Elizabeth St., South Bound Brook, NJ (US) 08880; Nancy Kordell, 218 Elizabeth St., South Bound Brook, NJ (US) 08880

( * ) Notice: Subject to any disclaimer, the term of this patent is extended or adjusted under 35 U.S.C. 154(b) by 0 days.

(21) Appl. No.: 10/371,819

(22) Filed: Feb. 21, 2003

Related U.S. Application Data

(60) Provisional application No. 60/358,121, filed on Feb. 21, 2002.

(51) Int. Cl.[7] ..... E04H 4/00
(52) U.S. Cl. ..... 4/499
(58) Field of Search ..... 4/499, 498

(56) References Cited

U.S. PATENT DOCUMENTS 3,600,721 A * 8/1971 Pusey ..... 4/499
4,000,527 A * 1/1977 Gannon ..... 4/499
4,129,905 A * 12/1978 Niemirow ..... 4/499
4,553,239 A * 11/1985 Akiba et al. ..... 372/50
4,685,254 A 8/1987 Terreri
4,825,479 A * 5/1989 Bonneau ..... 4/499
4,847,925 A * 7/1989 Perry ..... 4/499
5,144,704 A * 9/1992 Genzel et al. ..... 4/499
5,901,503 A * 5/1999 Dalene et al. ..... 52/2.11
6,052,843 A 4/2000 Pirillo
6,286,157 B1 * 9/2001 Baumann ..... 4/503

* cited by examiner

*Primary Examiner*—Charles E. Phillips
(74) *Attorney, Agent, or Firm*—Matthew J. Peirce

(57) ABSTRACT

A pool cover for use with pools is disclosed. The apparatus is a pool cover which comprises a centrally located bubble, a series of branches that would be connected to the centrally located bubble, and a series of cover sections that would be located in between the series of branches. The bubble would be designed to be centrally located on the cover and would be inflatable. The branches would serve as a skeletal framework and would also be used to removably tie down or attach the pool cover to the structure of the pool or to external securing objects.

4 Claims, 1 Drawing Sheet

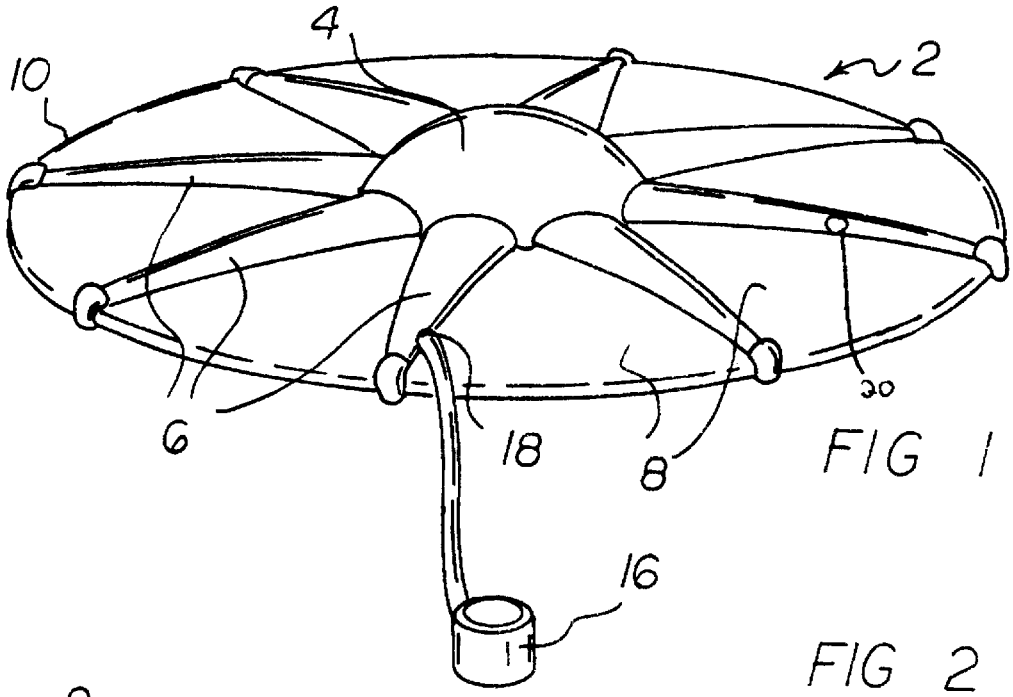
FIG 1
FIG 2
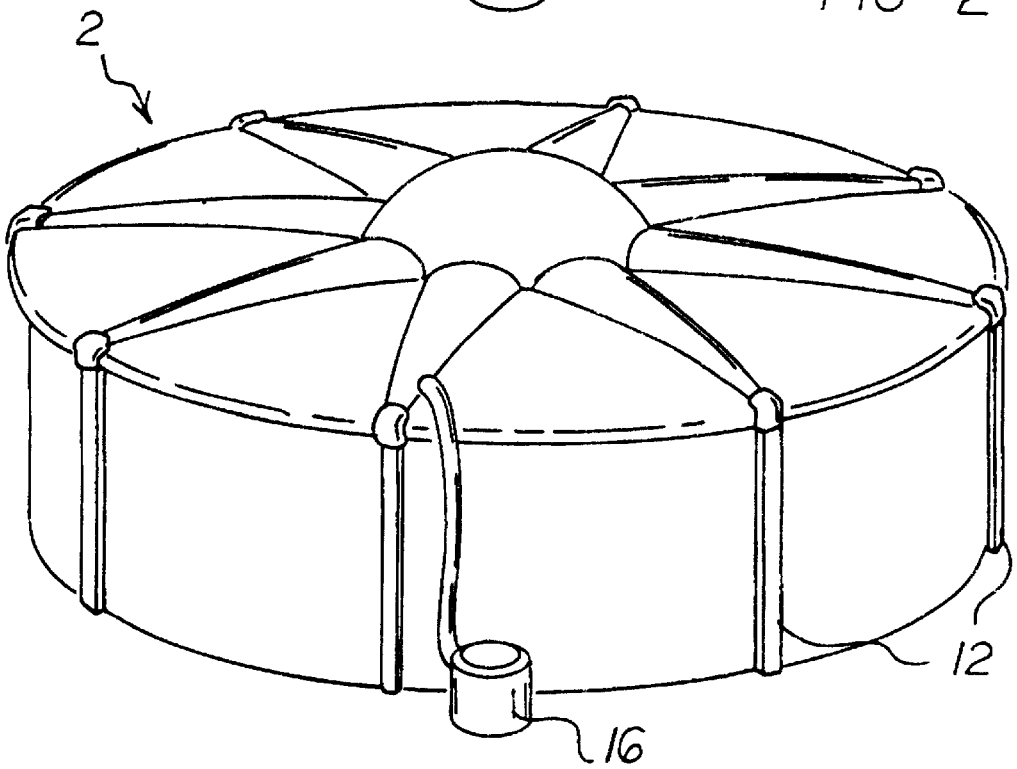

BUBBLE EASE

Priority is hereby claimed to application No. 60/358,121, filed on Feb. 21, 2002.

I. BACKGROUND OF THE INVENTION

The present invention concerns that of a new and improved apparatus for use with pools.

II. DESCRIPTION OF THE PRIOR ART

U.S. Pat. No. 6,052,843, issued to Pirillo, discloses a pool cover with means to support an inflatable floatable device.

U.S. Pat. No. 5,901,503, issued to Dalene, discloses a winter covering for a swimming pool comprised of a plurality of inflatable sections.

U.S. Pat. No. 4,685,254, issued to Terreri, discloses a swimming pool cover with a balloon capable of being inflated with an air hose.

III. SUMMARY OF THE INVENTION

The present invention concerns that of a new and improved apparatus for use with pools. The apparatus is a pool cover which comprises a centrally located bubble, a series of branches that would be connected to the centrally located bubble, and a series of cover sections that would be located in between the series of branches. The bubble would be designed to be centrally located on the cover and would be inflatable. The branches would serve as a skeletal framework and would also be used to removably tie down or attach the pool cover to the structure of the pool or to external securing objects.

There has thus been outlined, rather broadly, the more important features of a pool cover that the detailed description thereof that follows may be better understood and in order that the present contribution to the art may be better appreciated. There are, of course, additional features of the pool cover that will be described hereinafter and which will form the subject matter of the claims appended hereto.

In this respect, before explaining at least one embodiment of the pool cover in detail, it is to be understood that the pool cover is not limited in its application to the details of construction and to the arrangements of the components set forth in the following description or illustrated in the drawings. The pool cover is capable of other embodiments and being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present pool cover. It is important, therefore, that the claims be regarded as including such equivalent constructions insofar as they do not depart from the spirit and scope of the present invention.

It is therefore an object of the present invention to provide a pool cover which has all of the advantages of the prior art and none of the disadvantages.

It is another object of the present invention to provide a pool cover which may be easily and efficiently manufactured and marketed.

It is another object of the present invention to provide a pool cover which is of durable and reliable construction.

It is yet another object of the present invention to provide a pool cover which is economically affordable and available for relevant market segment of the purchasing public.

Other objects, features and advantages of the present invention will become more readily apparent from the following detailed description of the preferred embodiment when considered with the attached drawings and appended claims.

IV. BRIEF DESCRIPTION OF THE DRAWINGS

FIG. 1 shows a perspective view of the pool cover.

FIG. 2 shows a perspective view of the pool cover as it would appear in use

V. DESCRIPTION OF THE PREFERRED EMBODIMENT

FIG. 1 shows a perspective view of the pool cover 2, while FIG. 2 shows a perspective view of the pool cover 2 as it would appear in use. Pool cover 2 would comprise a centrally located bubble 4, a series of branches 6 that would be connected to the centrally located bubble 4, and a series of cover sections 8 that would be located in between the series of branches 6.

Bubble 4 would be designed to be centrally located on cover 2. Bubble 4 would not necessarily be circular, but could be a wide variety of shapes. However, the circular shape would likely be most appropriate for bubble 4. In addition, cover 2 would not need to be circular, as it could be designed in a wide variety of shapes for various shaped pools.

The cover 2 would also have a plurality of branches 6 that would connect the bubble 4 to the outer rim of the cover. Each branch 6 would have two ends, an inner and an outer end, with the inner end of each branch being the end that would connect to the bubble 4 and the outer end of each branch 6 touching the outer framework 10 of the cover 2. The branches would be open-air connected with the bubble 4, although the outer ends of each branch 6 would be capped off. The branches 6 would serve as a skeletal framework of the cover 2. The outer end of each branch would be used to anchor the cover 2 to either a securing post 12 on a pool structure or alternatively, could be used to tie down the cover 2.

Cover 2 would also include a plurality of cover sections 8 that would be located in between adjacent branches 6. Each cover section 8 would be cut appropriately to ensure that the entire surface of the pool would be covered. Further, each cover section 8 would be fixedly attached to the adjacent branches 6 to ensure that once the outer ends of the branches would be secured, the cover sections 8 would not rotate around the water surface within a pool.

Pool cover 2 would also be used with air pump 16, which would be a detachable air pump and would be used to inflate the branches 6 and the bubble 4 on cover 2. Air pump 16 would be attachable to valve 18 that would preferably be located on a branch 6 of the cover 2. In addition, pool cover 2 would also preferably have a release valve 20, which would be located on one of the branches 6 as well.

In order for the present invention to work properly, the water level within the pool would be below the skimmer level, which would be near the top of the pool border. In addition, bubble 4 lies on top of the water level within the pool.

We claim:

1. A pool cover comprising:

(a) an exterior framework serving as the perimeter of the pool cover, (b) a plurality of branches, each branch having two ends, a first end and a second end, the first end of each branch fixedly connected to the exterior framework, (c) a central air bubble, the air bubble connected to the second end of each of the branches, the air bubble having open-air connections with the second end of each branch, (d) a plurality of covers, each cover being located in between adjacent branches, each cover fixedly attached to the adjacent branches, (e) means for inflating the pool cover, (f) mean on said first end of each branch for attaching the pool cover to a fixed object, and (g) a air release valve located on one of the branches.

2. A pool cover according to claim 1 wherein the means for inflating the pool cover further comprises:

(a) a detachable air pump, (b) an air valve located on one of the branches, (c) wherein an individual would attach the detachable air pump to the air valve and proceed to utilize the detachable air pump until the pool cover had a sufficient amount of air.

3. A pool cover according to claim 2 wherein the pool cover would have a round shape.

4. A pool cover according to claim 2 wherein the central air bubble would have a round shape.

* * * * *